US006369509B1

(12) United States Patent
Ookubo et al.

(10) Patent No.: US 6,369,509 B1
(45) Date of Patent: Apr. 9, 2002

(54) SHORT ARC LAMP WITH CRACK-PREVENTING ELECTRIC MOUNTING ARRANGEMENT

(75) Inventors: Keisuke Ookubo; Toshiyuki Shima; Shinkichi Morimoto, all of Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/184,949

(22) Filed: Nov. 3, 1998

(30) Foreign Application Priority Data

Nov. 7, 1997 (JP) ..... 9-320581

(51) Int. Cl.[7] ..... H01J 61/36; H01J 1/88

(52) U.S. Cl. ..... 313/623; 313/243; 313/632; 313/292

(58) Field of Search ..... 313/623, 624, 313/625, 631, 632, 331, 332, 326, 633, 491, 292, 271, 283, 285, 243, 251, 252, 284

(56) References Cited

U.S. PATENT DOCUMENTS

| | | | | |
|---|---|---|---|---|
| 4,038,578 A | | 7/1977 | Mathijssen | |
| 4,507,584 A | * | 3/1985 | Coaton et al. | 313/624 |
| 4,559,472 A | * | 12/1985 | Triebel et al. | 313/623 |
| 5,451,837 A | * | 9/1995 | Stevens | 313/631 |
| 5,744,905 A | * | 4/1998 | Mehrotra et al. | 313/633 |
| 5,859,492 A | * | 1/1999 | Austad et al. | 313/623 |
| 6,190,466 B1 | * | 2/2001 | Apagyi et al. | 313/315 |

OTHER PUBLICATIONS

Patent Abstracts of Japan, vol. 017, No. 219 (E–1358), Apr. 30, 1993, & JP 04 355046 A (Ushio Inc.,) Dec. 9, 19982 * English Abstract *.

Patent Abstracts of Japan, vol. 196, No. 011, Nov. 29, 1996, & JP 08 180839 A, (Ushio Inc.), Jul. 12, 1996 * Engih Abstract*.

Patnet Abstracts of Japan, vol. 098, No. 010, Aug. 31, 1998, & JP 10 144262 A (Toto Ltd)., May 29, 1998, *English Abstract*.

* cited by examiner

*Primary Examiner*—Michael H. Day
*Assistant Examiner*—Joseph Williams
(74) *Attorney, Agent, or Firm*—Nixon Peabody LLP; David S. Safran

(57) ABSTRACT

A short arc lamp in which cylindrical retaining bodies can be easily and reliably attached in upholding parts of the electrodes on a temporary basis and in which also the disadvantages which are caused by an anomalous discharge immediately after starting of lamp operation can be eliminated are achieved in a short arc lamp in which a cathode and an anode opposite one another in an arc tube having side parts on opposite sides, in which the upholding parts of the cathode and anode electrodes are inserted and held in cylindrical retaining bodies, and in which the cylindrical retaining bodies are supported in the shrunken regions of the side tubes by the upholding parts of the electrodes being wound with coil components which border the faces of the cylindrical retaining bodies that face the electrodes, and by the cylindrical retaining bodies being temporarily attached by these coil components. Furthermore, as the coil components, a coil wound which is formed of a flexible foil lead that has been bent in the middle region of the flexible coil lead and wound so that the two ends of the flexible coil lead are located on the side closest to the electrode.

10 Claims, 3 Drawing Sheets

SHORT ARC LAMP WITH CRACK-PREVENTING ELECTRIC MOUNTING ARRANGEMENT

BACKGROUND OF THE INVENTION

1. Field of the Invention

The invention relates to a short arc lamp as is used for a light source for purposes of UV exposure in production of LSI or for similar purposes.

2. Description of Related Art

In a short arc lamp, within a spherical or oval arc tube made of fused silica glass, an anode and cathode are disposed opposite one another with a gap therebetween. A side tube is connected to each of opposite ends of the arc tube and in which upholding parts of the cathode and anode are sealed. To hold the cathode and anode upholding parts securely, a negative pressure state is caused in the arc tube and the ends of the side tubes are heated so that the diameter of the side tube is reduced and shrunken areas are formed. To directly hold the upholding parts of the electrodes of the cathode and anode in the shrunken regions of the side tube, it is necessary to draw the side regions very strongly. The outer peripheral surfaces of the upholding parts of the cathode and anode are therefore wound with molybdenum foils with a thickness from roughly 15 to 30 microns. The wound locations are inserted and held in fused silica glass cylindrical retaining bodies, and the shrunken regions of the side tubes are welded to the cylindrical retaining bodies. In this way, the cylindrical retaining bodies are integrally joined with the shrunken areas of the side tube and attached. Furthermore, the advantage resulting from welding the shrunken regions of the side tube and the cylindrical retaining bodies to one another in an integral arrangement is that the thickness of these locations becomes greater and in this way strength is increased. The reason for winding of the upholding parts of the electrodes with molybdenum foil is to absorb the expansion of the upholding parts of the electrodes with increases in temperature which occur during lamp operation, and to prevent a high load from being exerted on the cylindrical retaining bodies.

During the drawing process, it is necessary to temporarily attach the cylindrical retaining bodies to the upholding parts of the electrodes to prevent the cylindrical retaining bodies from moving along the upholding parts of the electrodes. Since, on the sides of the cylindrical retaining bodies which are opposite the electrodes, there are conductive foils for purposes of power supply, the cylindrical retaining bodies can be temporarily attached using these foils. This prevents the cylindrical retaining bodies from moving in away from the electrodes.

Therefore, temporary attachment which is used to prevent movement of the cylindrical retaining bodies towards the electrode side is needed. Conventionally, therefore, the following was done, as shown in FIG. 4:

One end of a temporarily attached molybdenum plate 28 with a thickness of roughly 0.1 mm, and which is made into the form of a strip, is welded to the upholding parts 20 of the electrodes.

The outer peripheral surface of the upholding parts 20 of the electrodes which surround this welded site, i.e. essentially half the temporarily attached plate 28 in the longitudinal direction, is wound with a molybdenum foil 27, and is inserted in a cylindrical retaining body 30 in a state in which the remaining half of the temporarily attached plate 28 projects from the retaining body 30.

The temporarily attached plate 28 which projects from one end of the cylindrical retaining body 30 is curled and brought into contact with a face of the cylindrical retaining body 30, as is illustrated in FIG. 5. In this way, the cylindrical body 30 is temporarily attached in the upholding parts 20 of the electrodes.

But, this temporary attachment had the following disadvantages:

Since the end of the temporarily attached plate which is made into the form of a strip is welded to the upholding parts of the electrode, and furthermore, the part of the temporarily attached plate which projects from an end of the cylindrical retaining body is curled, greater production cost is necessary.

In the winding of the temporarily attached plate with molybdenum foil, there are cases in which the thin molybdenum foil is cut by the edge of the temporarily attached plate. Furthermore, in bending the temporarily attached plate into the form of a curl, there were cases in which the molybdenum foil was cut by the temporarily attached plate moving upward.

Since the curled part of the temporarily attached plate bent is in contact with the face of the cylindrical retaining body at only one point, the welded site of the temporarily attached plate is damaged by the weight of the cylindrical retaining body, if the side tube is shrunk while the arc tube is being turned. Therefore, there were cases in which the cylindrical retaining body moved, i.e. temporary attachment was only incompletely obtained.

During lamp operation, there were cases in which, immediately after turning on and before starting the discharge between the electrodes, an anomalous discharge occurred proceeding from edges of the temporarily attached plates. While the starting point of the discharge moves from the edges of the temporarily attached plates to the electrode tips until a normal discharge takes place, the temporarily attached plates begin to partially melt. A molten mass of molybdenum is deposited on the boundary regions between the cylindrical retaining bodies and the shrunken regions of the side tube. Therefore, there were cases in which cracks formed in these regions of the arc tube and in the shrunken regions. Furthermore, there were also cases in which the lamp finally broke when these cracks grew.

SUMMARY OF THE INVENTION

Therefore, a primary object of the invention is to devise a short arc lamp in which cylindrical retaining bodies can be easily and reliably attached in upholding parts of the electrodes on a temporary basis without damage to the molybdenum foils with which the upholding parts of the electrodes are wound, and in which crack formation in the boundary regions between the arc tube and the shrunken regions can be prevented, even if immediately after starting of lamp operation an anomalous discharge forms.

According to the invention, in a short arc lamp in which the arc tube contains a cathode and an anode disposed opposite one another, and in which upholding parts of the cathode and anode are inserted and held in cylindrical retaining bodies, and in which the cylindrical retaining bodies are supported in the shrunken regions of side tubes connected to the arc tube, this object is achieved by the upholding parts of the electrodes being wound with coil components which border the electrode-side faces of the cylindrical retaining bodies and by the cylindrical retaining bodies being temporarily attached by these coil components.

According to another aspect of the invention, the indicated object is achieved by grooves in which the coil components fit being formed in the upholding parts of the electrodes. This measure prevents the coil components from moving. Therefore, the effect of the temporary attachment of the cylindrical retaining bodies can be ensured even more.

When coil components are used as the components for temporary attachment, there is a great probability that the starting point of the anomalous discharge will be located on the sharp ends of the flexible coil leads immediately after starting. Such a problem is solved, however, according to the invention, the coil being wound in two stages and by its having been formed by bending the middle region of the flexible coil lead and by two-layer winding, in which the two ends of the flexible coil lead are located on the same side, and by the ends of the flexible coil lead being located on the electrode sides.

By this measure, the two ends of the flexible coil lead, i.e. the starting point of the anomalous discharge, are located in positions away from the cylindrical retaining bodies, i.e. in positions which are away from the border regions between the cylindrical retaining bodies and the shrunken regions of the side tube.

This prevents the molten mass from being deposited on the border regions between the cylindrical retaining bodies and the shrunken regions of the side tube, even if the ends of the flexible coil lead begin to melt. Therefore, crack formation can be prevented.

However, the object can also be achieved in accordance with the invention by the coil components being formed from tungsten which contains emitters. This measure can suppress vaporization of the tungsten of the coil components and prevent blackening of the arc tube.

In the following the invention is further described using several embodiments shown in the drawings.

DETAILED DESCRIPTION OF THE INVENTION

Figure 1:
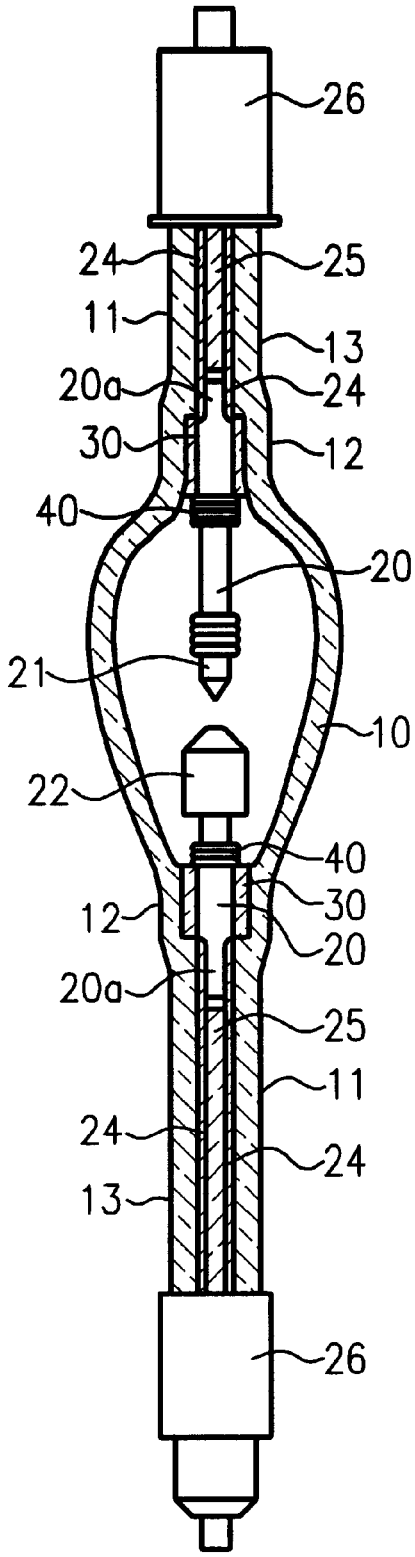
FIG. 1 is a schematic cross section of the short arc lamp in accordance with the invention.

FIG. 1 is a schematic of a short arc lamp which is used for LSI exposure. This short arc lamp has a nominal power consumption of 700 W, a lamp voltage of 44 V and a lamp current of 15.9 A. From each two opposite ends of a roughly oval arc tube 10 of fused silica glass, there extends a side tube 11 with an inside diameter of 8 mm. In the arc tube 10, on the tips of the upholding parts 20 of the electrodes, there are a cathode 21 and an anode 22 disposed opposite one another with a gap of 3 mm between them. The upholding parts 20 of the electrodes each are made of a tungsten rod with an outside diameter of 3 mm. The ends of the upholding parts 20 are flattened by machining. On the sides of each of these flattened areas 20*a,* a respective conductive foil 24 of molybdenum is connected. A plate 25 of fused silica glass is fixed between the two conductive foils 24.

The upholding parts 20 of the electrodes are each inserted into a cylindrical retaining body 30 of fused silica glass with an outside diameter of 6 mm and a length of 8 mm. Furthermore, between the upholding parts of the electrodes 20 and cylindrical retaining body 30, there is a molybdenum foil 27 (FIG. 2) for absorbing the expansion of the upholding parts 20 during lamp operation. The inside of the arc tube 10 is brought into a negative pressure state. The diameter of the side tube 11 is reduced by heating. The conductive foils 24 are sealed in flattened, sealed portions 13. The cylindrical retaining bodies 30 are attached in shrunken regions 12. The ends of the side tube 11 are each provided with bases 26.

Figure 2:
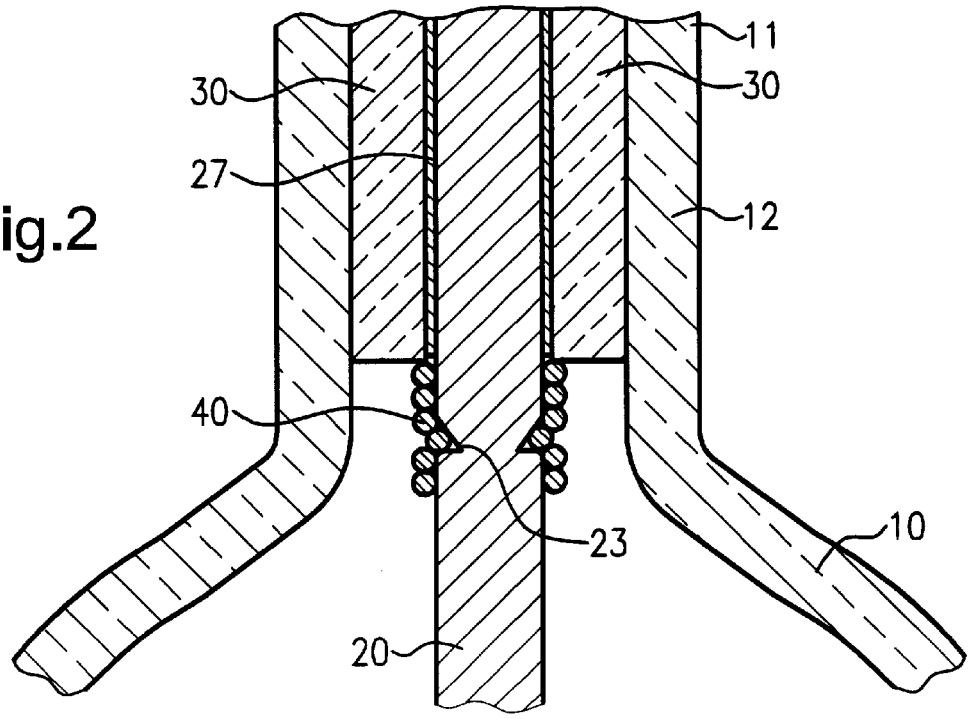
FIG. 2 is an enlarged view of parts of the FIG. 1 lamp important to the invention.

As shown in FIG. 2, the upholding parts 20 of the electrodes are wound with coil components 40. These coil components 40 are each produced by tightly winding a tungsten wire with a flexible lead diameter of 0.4 mm and a length of roughly 5 mm. The coil components 40 do not move, even if they are exposed to a force to some extent. The coil components 40 border the electrode-side faces of the cylindrical retaining bodies 30. These coil components 40 are components for temporary attachment which, in the process of reducing the diameter of the side tube 11 by heating, prevent the cylindrical retaining bodies 30 from moving along the upholding parts 20 of the electrodes towards the respective cathode or anode since the coils border the electrode-side faces of the cylindrical retaining bodies 30.

If, as also is shown in FIG. 2, a circular groove 23, into which the flexible lead of the coil component 40 fits, is formed in the upholding parts 20 of the electrodes, inward movement is prevented even if the coil component 40 is exposed to a high force. Thus, the effect of temporary attachment can be ensured even more.

The ends of the conductive foils 24 border the faces of the cylindrical retaining bodies 30 which are opposite the electrodes. This prevents the cylindrical retaining bodies 30 from moving along the upholding parts 20 of the electrodes in a direction outwardly away the respective cathode or anode. This means that the cylindrical retaining bodies 30 are temporarily attached so that they do not move in any direction along the upholding parts 20 of the electrodes.

By winding the upholding parts 20 of the electrodes with the coil components 40, in this way, the cylindrical retaining bodies 30 are temporarily attached. In this way, temporary attachment can be achieved with certainty. Furthermore, the arrangement is simple so that the lamp can be produced extremely easily. In addition, damage to the molybdenum foils 27 present between the upholding parts 20 of the electrodes and the cylindrical retaining bodies 30 is prevented.

Figure 3:
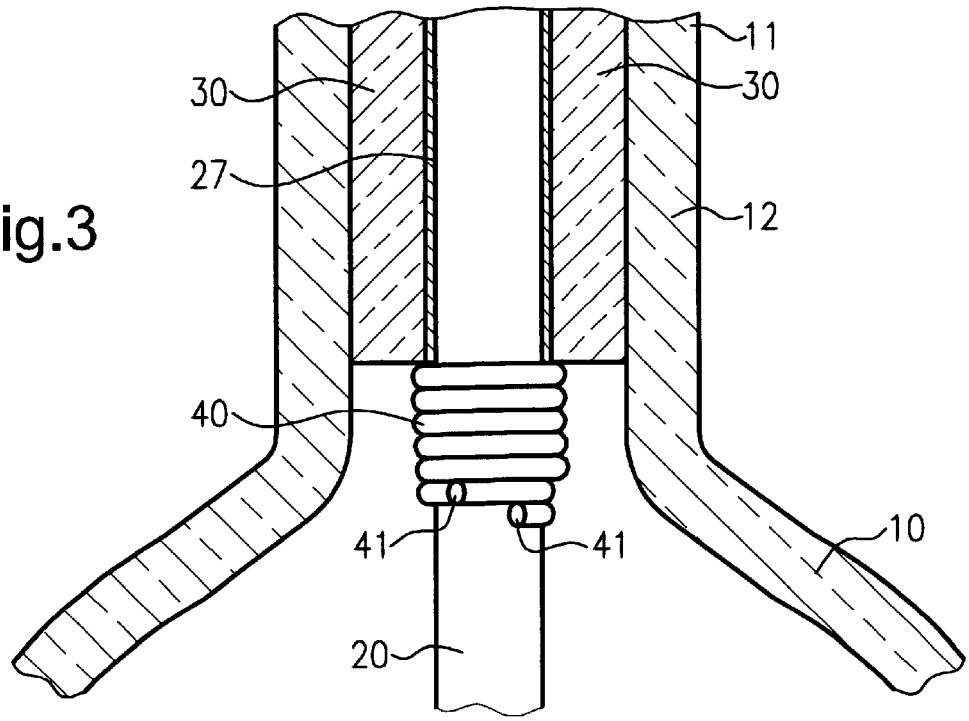
FIG. 3 is a view corresponding to that of FIG. 2, but showing another embodiment of the invention.
Figure 4:
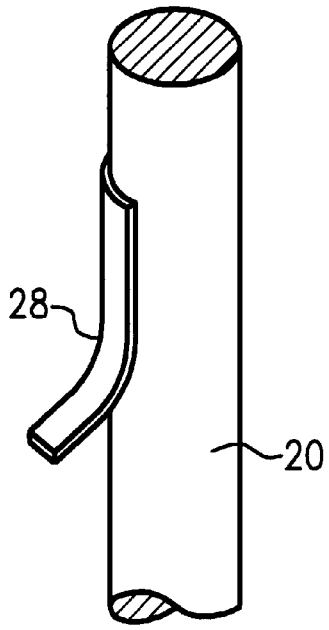
Fig.4 (Prior Art)
FIG. 4 is a schematic showing a conventional production process.
Figure 5:
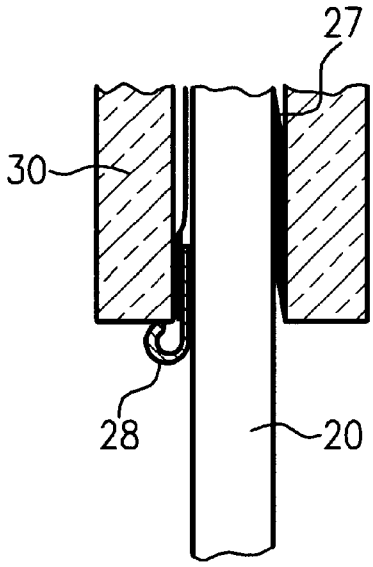
Fig.5 (Prior Art)
FIG. 5 is a schematic of another stage in the conventional production process of FIG. 4.

Additionally, it is preferred that the coil components 40 be formed by a coil wound in two layers at a time by bending the middle region of the flexible coil lead into two-layers in which the ends 41 of the flexible coil lead are located on one side and the bend on the opposite side. Furthermore, the coil components are wound so that two ends 41 of the flexible coil lead are located on the side closest to the respective electrode or anode, as is illustrated in FIG. 3.

In this arrangement, the probability is greater that the starting point of an anomalous discharge will be located on the ends 41 of the flexible coil lead immediately after starting of lamp operation. However, since the ends 41 of the flexible coil lead are located in positions which are away from the boundaries between the cylindrical retaining bodies 30 and the shrunken regions 12 of the side tube 11, the resulting molten mass of coil material is prevented from being deposited on the border regions between the cylindrical retaining bodies 30 and the shrunken regions 12 of the side tube 11 even if the ends 41 of the flexible coil lead begin to melt due to an anomalous discharge. Therefore, crack formation can be prevented.

Still further, by forming the coil components 40 from tungsten which contains emitters such as thorium, cerium, yttrium, or the like, vaporization of the tungsten of coil components 40 can be suppressed and blackening of the arc tube 10 can be prevented.

Action of the Invention

As was described above, in accordance with the invention, in a short arc lamp in which a cathode and an anode are disposed opposite one another in an arc tube, in which upholding parts of the cathode and anode are inserted and held in cylindrical retaining bodies, and in which the cylindrical retaining bodies are supported in shrunken regions of side tubes connected to the arc tube at opposite ends, the upholding parts of the electrodes are wound with coil components which border the electrode-side faces of the cylindrical retaining bodies and the latter are temporarily attached by these coil components.

This measure prevents damage to the molybdenum foils present between the upholding parts of the electrodes and the cylindrical retaining bodies. The cylindrical retaining bodies can be temporarily attached in the upholding parts of the electrodes easily and with certainty.

Furthermore, the coil components are wound in two layers at the same time by bending the middle region of a flexible coil lead and a two-layer winding it so that the two ends of the flexible coil lead are located on the same side, and are located on the inner side closest to the respective anode or cathode.

This measure yields a short arc lamp in which crack formation in the boundary regions between the arc tube and the shrunken regions can be prevented even if an anomalous discharge forms immediately after starting of lamp operation.

Moreover, the measure according to the invention by which grooves are formed in the upholding parts of the electrodes into which the coil components fit prevents the coil components from moving. Therefore, the effect of temporary attachment can be ensured even more.

Furthermore, the measure according to the invention by which the coil components are formed from tungsten which contains emitters suppresses vaporization of the tungsten of the coil components and prevents blackening of the arc tube.

We claim:

1. Short arc lamp comprising an arc tube having a side tube at each of opposite sides thereof, a cathode electrode and an anode electrode disposed opposite one another in said arc tube, a respective upholding part supporting each of the electrodes, each upholding part being inserted and tightly held by a cylindrical retaining body that is tightly held in a shrunken region of a respective side tube; wherein each upholding part is wound with a coil component with an end of the coil component being at a location which borders an end face of the cylindrical retaining bodies which faces the electrodes.

2. Short arc lamp as claimed in claim 1, wherein the coil components are fit into grooves formed in the upholding parts of the electrodes.

3. Short arc lamp as claimed in claim 2, wherein each coil component is wound in two layers formed of a flexible coil lead folded in the middle; and wherein ends of the flexible coil lead are located together on a side of the coil component closest to the electrodes.

4. Short arc lamp as claimed in claim 1, wherein each coil component is wound in two layers formed of a flexible coil lead folded in the middle; and wherein ends of the flexible coil lead are located together on a side of the coil component closest to the electrodes.

5. Short arc lamp as claimed claim 4, wherein the coil components are made of tungsten which contains emitters.

6. Short arc lamp as claimed in claim 5, wherein the emitters are selected from the group consisting of thorium, cerium or yttrium.

7. Short arc lamp as claimed claim 1, wherein the coil components are made of tungsten which contains emitters.

8. Short arc lamp as claimed in claim 7, wherein the emitters are selected from the group consisting of thorium, cerium or yttrium.

9. Short arc lamp as claimed in claim 8, wherein the coil components are fit into grooves formed in the upholding parts of the electrodes.

10. Short arc lamp as claimed in claim 7, wherein the coil components are fit into grooves formed in the upholding parts of the electrodes.

* * * * *